343-700 MS AU 256 EX
12/26/78 OR 4,131,893

United States Patent [19]

Munson et al.

[11] 4,131,893

[45] Dec. 26, 1978

[54] MICROSTRIP RADIATOR WITH FOLDED RESONANT CAVITY

[75] Inventors: Robert E. Munson; Gary G. Sanford, both of Boulder, Colo.

[73] Assignee: Ball Corporation, Muncie, Ind.

[21] Appl. No.: 783,541

[22] Filed: Apr. 1, 1977

[51] Int. Cl.[2] ..... H01Q 1/38; H01Q 1/48

[52] U.S. Cl. ..... 343/700 MS; 343/846

[58] Field of Search ..... 343/700 MS, 705, 708, 343/768, 756, 770, 771, 789, 846

[56] References Cited

U.S. PATENT DOCUMENTS

| | | | |
|---|---|---|---|
| 2,684,444 | 7/1954 | Fales | 343/770 |
| 3,478,362 | 11/1969 | Ricardi et al. | 343/700 MS |
| 3,823,404 | 7/1974 | Buie, Jr. | 343/770 |
| 4,051,477 | 9/1977 | Murphy et al. | 343/700 MS |

FOREIGN PATENT DOCUMENTS

| | | | |
|---|---|---|---|
| 629893 | 9/1949 | United Kingdom | 343/771 |

*Primary Examiner*—Alfred E. Smith
*Assistant Examiner*—Harry Barlow
*Attorney, Agent, or Firm*—J. David Haynes

[57] ABSTRACT

A resonant microstrip radiator wherein the size of the radiator is reduced in the resonant or non-resonant dimensions, or both, without reducing the effective resonant dimension or substantially lowering the efficiency of the radiator. Reduction of the resonant dimension is provided by folding the resonant cavity, while reduction of the non-resonant dimension is facilitated by utilization of a low density, low loss dielectric, such that the loss resistance of the element is appreciable with respect to the radiation resistance of the element. Also disclosed are interdigitated antenna structures and provisions for circularly or elliptically polarized radiation.

37 Claims, 5 Drawing Figures

Figure 3:
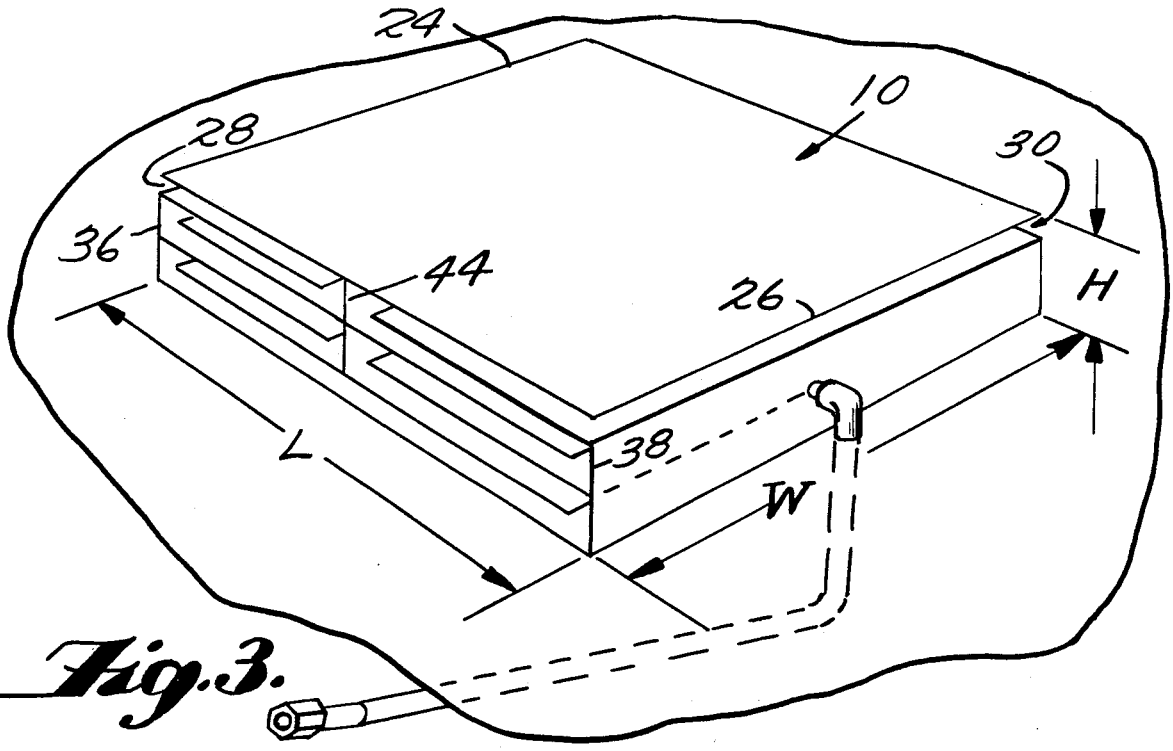

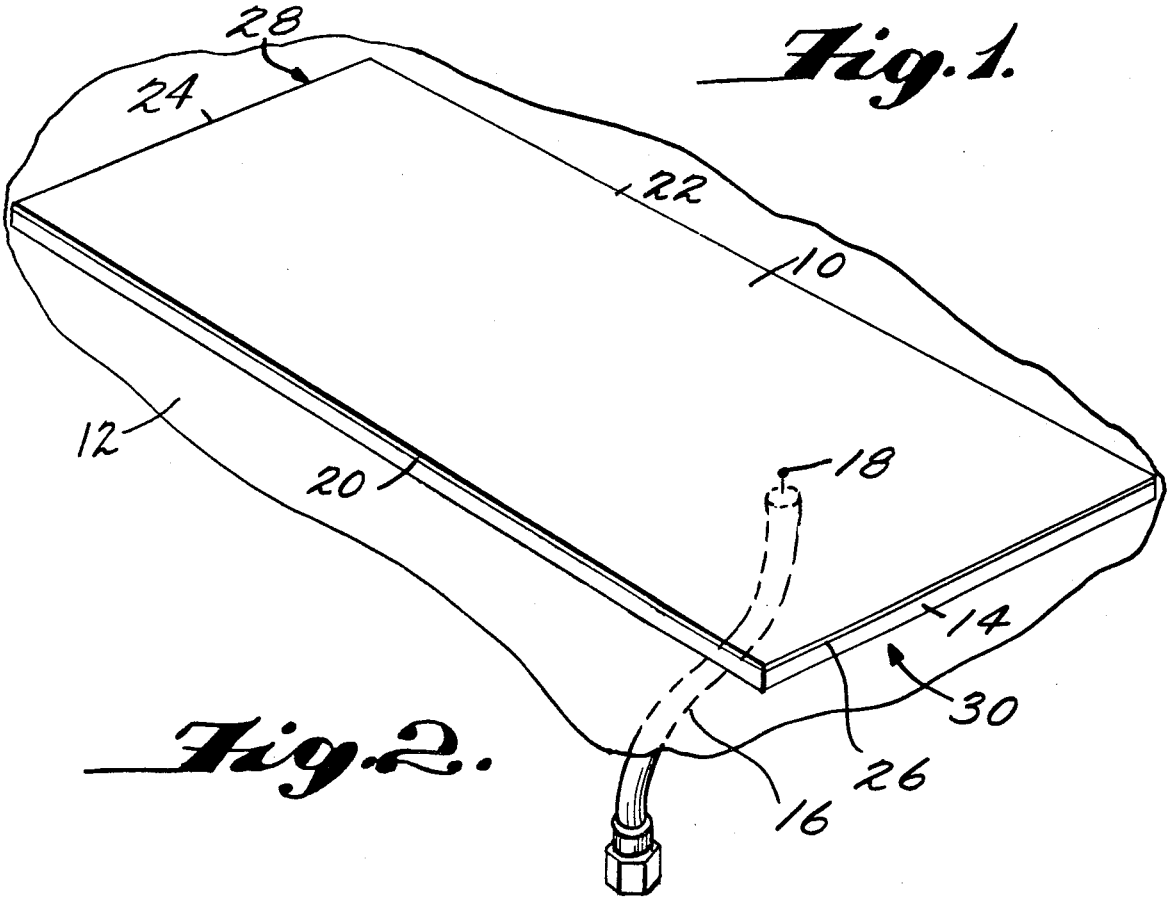
Fig. 1.
Fig. 2.
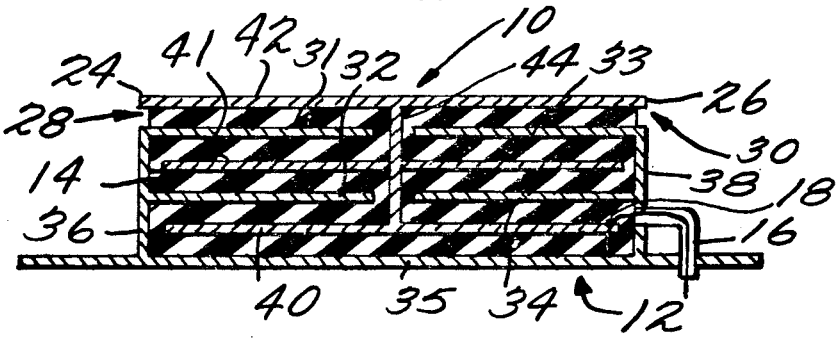
Fig. 4.
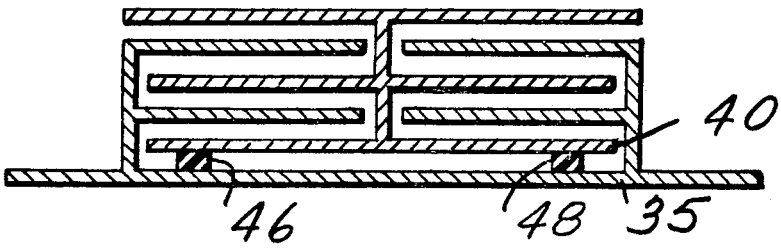

MICROSTRIP RADIATOR WITH FOLDED RESONANT CAVITY

The present invention relates to radio frequency antenna structures and more specifically to resonant microstrip radiator elements. A related circularly or elliptically polarized antenna untilizing this invention is claimed in a related copending commonly assigned application Ser. No. 783,542 filed concurrently herewith in the name of R. E. Munson, G. G. Sanford and L. R. Murphy.

In general, microstrip radiators are specially shaped and dimensioned conductive surfaces formed on one surface of a planar dielectric substrate, the other surface of such substrate having formed hereon a further conductive surface commonly termed the "ground plane." Microstrip radiators are typically formed, either singly or in an array, by conventional photoetching processes from a dielectric sheet laminated between two conductive sheets. The planar dimensions of the radiating element are chosen such that one dimension is on the order of a predetermined portion of the wavelength of a predetermined frequency signal within the dielectric substrate, and the thickness of the dielectric substrate chosen to be a small fraction of the wavelength. A resonant cavity is thus formed between the radiating element and ground plane, with the edges of the radiating element in the non-resonant dimension defining radiating slot apertures between the radiating element edge and the underlying ground plane surface. For descriptions of various microstrip radiator structures, reference is made to U.S. Pat. Nos. 3,713,162, issued Jan. 23, 1973 to R. Munson et al.; 3,810,183, issued May 7, 1974 to J. Krutsinger et al; and 3,811,128 and 3,921,177, respectively, issued on May 7, 1974 and on Nov. 18, 1975 to R. Munson and also to copending applications Ser. Nos. 707,418, filed Aug. 25, 1975 by R. Munson; 596,263, filed July 16, 1975 by J. Krutsinger et al.; 620,196 and 683,203, filed Oct. 6, 1975 and May 4, 1976, respectively, by G. Sanford; 658,534, filed Feb. 17, 1976 by L. Murphy; 666,174, filed Mar. 12, 1976 by R. Munson et al; 723,643, filed Sept. 15, 1976 by M. Alspaugh et al, and 759,856, filed Jan. 1, 1977 by G. Sanford et al. — all commonly assigned with the present invention to Ball Corporation.

A dilemma arises in the prior art with respect to constraints on the minimum size of antenna elements. By definition, the effective resonant dimension of the resonant cavity, defined by the radiating element (commonly called the "E-plane dimension") must be approximately a predetermined portion of a wavelength of the operating frequency signal in the dielectric. The prior art has generally attempted to reduce the size of the antenna elements by utilizing substrates with high dielectric constants to, in effect, reduce the wavelength of the resonant frequency within the dielectric subtrate and thereby allow for a smaller resonant dimension. Such an approach, however, is disadvantageous in that the use of a high dielectric substrate increases the loss conductance of the cavity and results in a larger non-resonant dimension, as will be explained, or significantly lower efficiency of the antenna or both.

The non-resonant dimension, commonly termed the "H-plane dimension," is determined in major part by the beam width and efficiency of the antenna. The efficiency of the antenna is typically expressed as a ratio of the power actually radiated to the power input, where the power input is (neglecting any reflected components) substantially equal to the sum of the power radiated and the power loss through heat dissipation in the dielectric. The equivalent circuit of the antenna element, with respect to power dissipation, may be expressed as a parallel combination of a radiation resistance and a dielectric loss resistance where the radiation and dielectric loss resistances are respectively defined as the resistances which, when placed in series with the antenna element, would dissipate the same amount of power as actually radiated by the element and as dissipated by the dielectric, respectively. The radiation power and dielectric loss are thus inversely proportional to the respective values of the radiation and loss resistances. The radiation resistance, however, is inversely proportional to the non-resonant dimension of the element. For a given dielectric, a required efficiency therefore prescribes the minimum non-resonant dimension of the element. Thus, conflicting criteria for reducing the respective dimensions of an antenna element existed in the prior art, in that the required effective resonant dimension of the element is determined by the wavelength of the resonant frequency signal in the dielectric and substrates having high dielectric constant to reduce such wavelength typically present a low loss resistance, requiring, therefore, a wider non-resonant dimension.

It should be appreciated that minimum size constraints can cause significant problems in applications where a large multiplicity of radiating elements are required, but limited spaced is available for antenna area, for example, a communication system antenna for use on an astronaut's backpack.

The present invention provides for a radiating element of reduced planar size without significantly decreasing the efficiency of the element, reducing the minimum non-resonant dimension by utilizing a low density, low loss dielectric substrate, and reducing the actual resonant dimension, while maintaining the effective resonant dimension at approximately a predetermined portion of a wavelength of the operating frequency in the dielectric by folding the resonant cavity.

A description of the preferred embodiment follows with reference to the accompanying drawing, wherein like numerals denote like elements, and:

FIG. 1 is a perspective view of a microstrip radiating element with narrowed non-resonant dimension in accordance with one aspect of the present invention.

Figure 5:
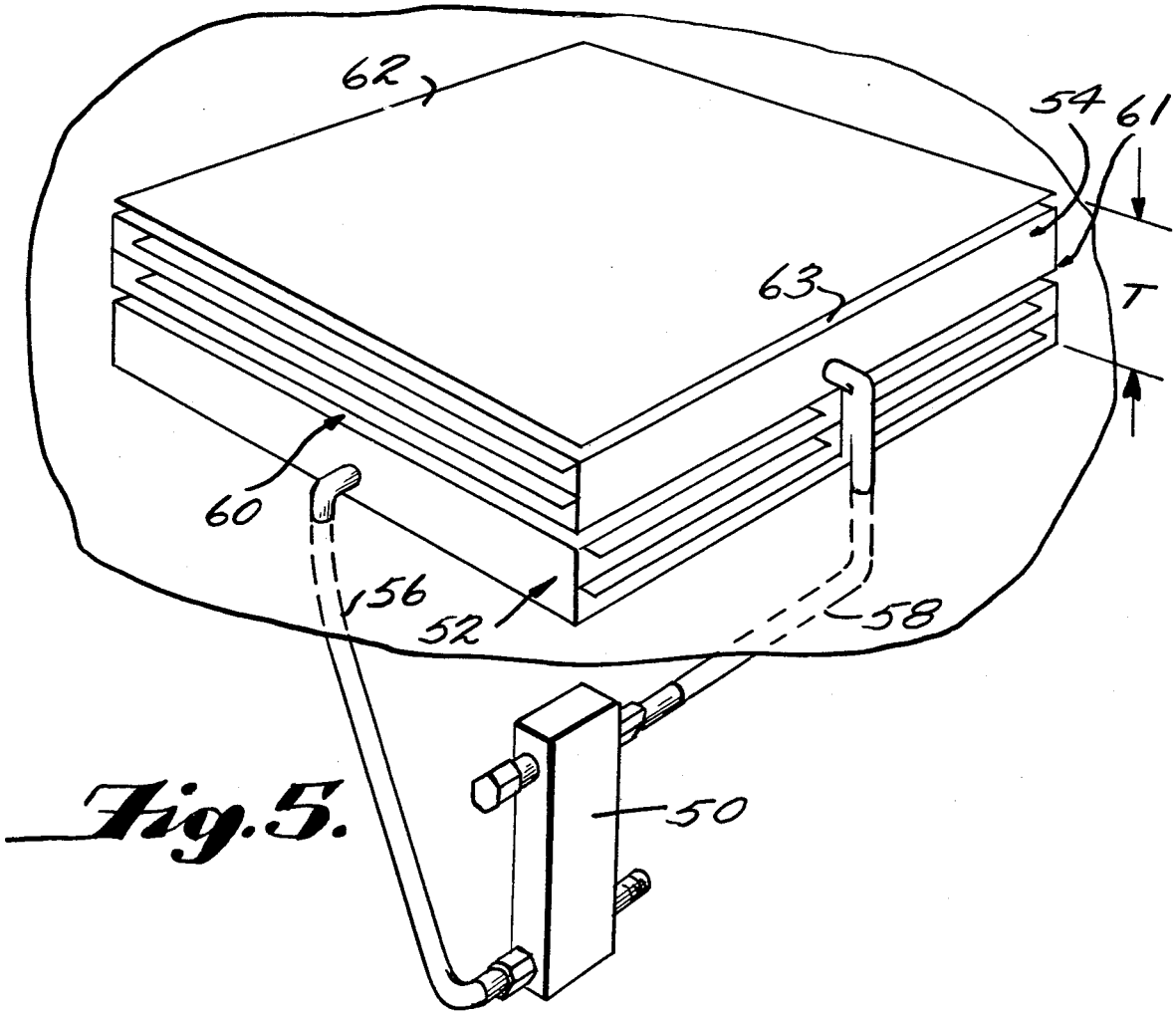

FIGS. 2 and 3, respectively, are sectional and perspective views of a folded microstrip radiating element in accordance with another aspect of the present invention;

FIG. 4 is a sectional view of an interdigitated antenna structure utilizing standoffs; and FIG. 5 shows a microstrip radiator adapted to radiate circularly polarized signals.

With reference to FIG. 1, a planar conductive radiating element 10 is insulated from a conductive ground plane 12, disposed parallel thereto, by a dielectric substrate 14. Signals of a predetermined operating frequency are applied to radiating element 10 and ground plane 12, for example, by a coaxial cable 16. Coaxial cable 16 is preferably coupled to radiating element 10 at a point 18 where the impedance of element 10 matches the impedance (typically 50 ohms) of the cable. Radiating element 10 is generally rectangular, having planar dimensions such that one set of edges 20 and 22 defines a resonant dimension approximately equal to one-half of the wavelength of the predetermined frequency signal in dielectric substrate 14, for example, 0.45 of the free space wavelength of the signal. Dielectric substrate 14 is a fraction of a wavelength, for example, 0.002 times the free space wavelength of the resonant frequency. A resonant cavity is formed between radiating element 10 and ground plane 12 with radiation emanating from radiating aperture slots 28 and 30 formed between edges 24 and 26 and ground plane 12.

Dielectric substrate 14 is preferably a low density, low loss expanded dielectric substance such as a honeycombed or foamed structure as described in the aforementioned copending application, Ser. No. 666,174, "High Efficiency, Low Weight Antenna," filed Mar. 12, 1976 by R. Munson and G. Sanford. Briefly, such expanded dielectric comprises, in substantial portion, voids to provide a rigid, low weight, low density, low loss structure. Expanded dielectrics, however, typically present a lower dielectric constant than non-expanded dielectric substrates, such as teflon-fiberglass typically used in the prior art. Thus, use of an expanded dielectric generally requires an elongation of the effective resonant dimension. However, the present inventors have discovered that the loss resistance of such expanded dielectric substrate is far greater than the loss resistance of non-expanded dielectric substrate, providing for a reduction in the minimum non-resonant dimension, substantially exceeding the increase in the resonant dimension required due to decreased dielectric constant. For example, the non-resonant dimension can be chosen to be 0.1 times the free space wavelength of the applied signal, as compared with 0.3–0.9 times the free space wavelength typical for the prior art. Thus, in accordance with one aspect of the present invention, a radiating element of reduced planar area can be constructed by utilizing an expanded dielectric substrate, and narrowing the non-resonant dimension. For example, a radiator of given efficiency utilizing a teflon-fiberglass substrate is 0.15 times the square of the free space wavelength, while a typical radiating element of such efficiency utilizing an expanded dielectric substrate and narrowed non-resonant dimension in accordance with the present invention is 0.05 times the square of the free space wavelength, a reduction in area by a factor on the order of 3.

The planar area of a radiating element can be further reduced in accordance with the present invention by, in effect, folding the resonant cavity. For example, the cavity can be folded along one or more axes perpendicular to the resonant dimension to create a tiered or layered structure. Alternately, a reduction in the planar size of the resonant cavity can be effected by folding or bending the microstrip into, for example, a "V" or "U" shape. FIGS. 2 and 3 depict an antenna wherein an interdigitated structure is utilized to effect a folded resonant cavity. Referring to FIGS. 2 and 3, generally ground plane 12 includes a plurality of longitudinally disposed planar conductive sheet sections 31–35 electrically connected by vertical side members 36 and 38. Radiating element 10 comprises a plurality of generally planar, longitudinally disposed conductive sheets 40–42 disposed in an interdigitated manner with respect to ground plane sections 31–35 separated therefrom by dielectric 14, and electrically connected by a vertical member 44, disposed parallel to side members 36 and 38. Apertures 28 and 30 are defined by the vertical most edges of radiating element 10. The cumulative distance from aperture 28 to aperture 30, through dielectric 14, is approximately equal to one-half wavelength of the operative frequency within the dielectric. Thus, radiating element 10 and ground plane 12 define a resonant cavity having radiating slot apertures 28 and 30 defined by edges 24 and 26 of radiating element 10 on opposite longitudinal sides of the antenna structure.

Such an interdigitated structure is, in effect, a planar microstrip element, for example such as shown in FIG. 1, folded from each end toward the middle, then folded again back toward the end along axes perpendicular to the resonant dimension and parallel to radiating apertures 28 and 30, such folding sequence repeated four times to provide a five tiered structure. It should be appreciated that interdigitated structures may be utilized to provide resonant cavities folded along a greater or lesser number of axes, with axes not necessarily parallel to the radiating aperture nor perpendicular to the resonant dimension. While it is not necessary, it is preferred that an odd number of tiers be effected such that the apertures are on opposite longitudinal sides of the antenna structure.

An input signal is applied to the radiating element via coaxial cable 16, with the center conductor connected to radiating element 10 at a point 18 of appropriate impedance. While cable 16 is shown coupled through the side of the antenna element in FIGS. 2 and 3, it should be appreciated that connection can be made in any appropriate manner such as, for example, through the bottom of ground plane 12 or from the resonant dimension side.

The planar length (L) of a five-tiered interdigitated structure, such as shown in FIGS. 2 and 3 having a non resonant dimension W on the order of 0.1 times the free space wavelength of the operating frequency, is also on the order of 0.1 times the free space wavelength, as opposed to 0.45 times the free space wavelength typical in a non-folded structure such as shown in FIG. 1. The height or thickness (H) of the interdigitated structure is on the order of 0.01 times the free space wavelength, as opposed to 0.002 times the free space wavelength in the unfolded element.

It should be appreciated that, while FIGS. 2 and 3 show an interdigitated structure wherein both of the side members are formed by ground plane 12, folded resonant cavities can be effected by interdigitated structures wherein one or both of the side members are formed by radiating element 10, and by interdigitated structures wherein a plurality of vertically disposed conductive elements are connected by longitudinally disposed members. Further, the conductive sheets need not be planar, but can be curved, nor need all the conductive sheets be of the same planar size. Moreover, the spacing between sheets need not be uniform or constant.

It should be appreciated that dielectric 14 can comprise a void with radiating element 10 being isolated from ground plane 12 by standoffs. Such a structure is shown in FIG. 4. Non-conductive standoffs 46 and 48 are disposed between ground plane element 35 and radiator element 40, to effect spatial separation between ground plane 12 and radiating element 10. The conductive sheets of radiator 10 and ground plane 12, in an embodiment utilizing standoffs, must be rigid enough to maintain the interdigitated separation. Where a solid or honeycombed or otherwise expanded dielectric is used, the conductive sheets can be extremely thin, with the dielectric providing structural support.

The interdigitated structure depicted in FIGS. 2 and 3 is particularly advantageous in the generation of circular or elliptically polarized signals. As described in the aforementioned U.S. Pat. 3,921,177 issued to R. Munson, the circular or elliptical polarization is generated utilizing a flat radiating element by applying equal amplitude signals, 90° out of phase, to adjacent (intersecting), perpendicular edges of the element. Such a technique is not feasible for use with folded or interdigitated elements. To provide circular or elliptical polarization, two interdigitated or folded elements are, in effect, stacked and rotated with respect to each other by 90° as shown in FIG. 5. Quadrature signals, as generated by, for example, a quadrature hybrid 50, are applied to respective stacked elements 52 and 54 via coaxial cables 56 and 58. Due to a masking effect by the upper element, it was found desirable to utilize cavities of approximately a half wavelength, and that the cavities maintain two radiating apertures on opposite sides of the element. It should be appreciated that, where the coaxial cables are coupled through vertical sides in the non-resonant dimension of the respective elements, the coaxial cables can be routed straight downward without interfering with the operation of radiating apertures 60–63. The thickness (T) of such stacked elements are typically on the order of 0.02 times the freespace wavelength of the operating frequency.

Radiating elements utilizing folded resonant cavities in accordance with the present invention have been built for operational frequency of between 259.7 MHz to 296.8 MHz. The elements constructed were interdigitated structures similar to that shown in FIGS. 2 and 3, and were stacked as shown in FIG. 5 to provide circular polarization. A radiation pattern of −10 db gain was achieved over approximately 80% spherical coverage. The physical package was 6" × 18" × 3" and weighed less than 0.45 Kg. The conductive sheets were formed of aluminum 0.005–.020 inch thick. The sheets were set in an interdigitated arrangement, furnace brazed and then sealed with tin. The structure was then set in a mold and the space between the conductive sheets filled with liquid expanding insulating resin. The resin hardened to provide rigidity.

An interdigitated antenna structure has also been constructed on a layer-by-layer approach, sandwiching a layer of honeycomb material between conductive sheets.

A seven tiered interdigitated antenna structure utilizing a dielectric comprising standoffs and a void has also been constructed. The conductive sheets were formed of brass on the order of 0.020 inch thick, and spacing between the interdigitated elements was maintained at 0.1 inch by transverse nylon screws running through the interdigitated elements.

It should be appreciated that folded cavities in accordance with the present invention can also be of lengths other than one-half wavelength. For example, quarter-wave cavities have been constructed with an appropriate impedance termination (e.g. a short circuit) in the cavity opposite the radiating aperture. Similarly, a full wavelength resonant cavity can be utilized. Other modifications of the exemplary embodiment may also be apparent and are to be included within the scope of the appended claims.

What is claimed:

1. In an antenna for operation at a predetermined frequency, of the type including a resonant cavity defined between two conductive sheets also defining a radiating aperture between the edge of at least one of the sheets and the remaining sheet, said resonant cavity having a longitudinal resonant dimension approximately equal to a predetermined multiple of one-quarter of a wavelength at said predetermined frequency, said cavity resonant dimension being no larger than one wavelength of said predetermined frequency, the improvement wherein:

said resonant cavity is folded along at least one axis transverse to said resonant dimension such that the longitudinal size of said antenna is reduced.

2. The antenna of claim 1 wherein said resonant cavity comprises, in substantial portion, voids.

3. The antenna of claim 2 wherein said resonant cavity comprises at least one non-conductive spacer separating said conductive sheets, and a void.

4. The antenna of claim 1 wherein said one axis is parallel to said radiating aperture and perpendicular to said resonant dimension.

5. The antenna of claim 4 wherein said resonant cavity is folded along a plurality of axes parallel to said aperture and perpendicular to said resonant dimension.

6. The antenna of claim 4 wherein said resonant cavity comprises, in substantial portion, voids.

7. The antenna of claim 6 wherein said resonant cavity comprises at least one non-conductive spacer separating said conductive sheets, and a void.

8. The antenna of claim 1 wherein said resonant cavity has two radiating apertures and said resonant cavity is folded such that said radiating apertures are disposed substantially in parallel, perpendicular to said resonant dimension, and at opposite longitudinal ends of said antenna.

9. The antenna of claim 8 wherein said resonant cavity comprises, in substantial portion, voids.

10. The antenna of claim 9 wherein said resonant cavity comprises at least one non-conductive spacer separating said conductive sheets, and a void.

11. In an antenna assembly for operation at a predetermined frequency of the type including first and second conductive sheets, said conductive sheets being disposed substantially in parallel and being separated by a dielectric material, said conductive sheets defining a resonant cavity therebetween having radiating slot apertures longitudinally spaced apart at a predetermined distance approximately equal to one-half wavelength of said predetermined frequency, the improvement wherein:

said conductive sheets and said dielectric material are folded along at least one axis parallel to at least one of said radiating apertures, folding thereby said resonant cavity such that the longitudinal dimension of said antenna assembly is reduced.

12. The antenna of claim 11 wherein said dielectric material comprises, in substantial portion, voids.

13. The antenna of claim 12 wherein said dielectric material comprises at least one non-conductive spacer separating said conductive sheets, and a void.

14. The antenna of claim 11 wherein said resonant cavity is folded such that said apertures are disposed substantially in parallel at opposite sides of said antenna assembly.

15. The antenna of claim 14 wherein said dielectric material comprises, in substantial portion, voids.

16. The antenna of claim 15 wherein said dielectric material comprises at least one non-conductive spacer separating said conductive sheets, and a void.

17. An antenna assembly for operation at a predetermined frequency comprising, in combination:

a first conductive element having a plurality of projecting sections;

a second conductive element having a plurality of projecting sections;

the projecting sections of said first and second conducting elements being disposed in an interdigitated manner, and being interspaced with a dielectric material, said first and second conductive elements defining a resonant cavity between the projecting sections thereof such that said resonant cavity is of a length no longer than approximately one wavelength of a signal at said predetermined frequency in said dielectric material and equal to approximately a predetermined multiple of one-quarter of a wavelength of said signal of said predetermined frequency in said dielectric material.

18. The antenna of claim 17 wherein said dielectric material comprises, in substantial portion, voids.

19. The antenna of claim 18 wherein said dielectric material comprises at least one non-conductive spacer separating said conductive elements, and a void.

20. The antenna of claim 17 wherein said conductive elements each comprise at least first conductive member disposed substantially parallel to a first plane and a plurality of uniformly spaced conductive members, connected to said first member and projecting therefrom, disposed substantially in parallel to a second plane substantially perpendicular to said first plane and wherein:

said first members are displaced by a predetermined distance along said second plane, and said projecting members are displaced by a predetermined distance along said first plane such that said first conductive element projecting members and said conductive element projecting members overlay and are alternately disposed.

21. The antenna of claim 20 wherein said dielectric material comprises, in substantial portion, voids.

22. The antenna of claim 21 wherein said dielectric material comprises at least one non-conductive spacer separating said conductive element, and a void.

23. The antenna of claim 20 wherein said conductive members are generally planar.

24. An antenna assembly of the type including a first conductive element separated from a second conductive element by a dielectric material, said first and second conductive elements defining a half-wave resonant cavity therebetween and at least one radiating aperture, the improvement wherein:

said first and second conductive elements each comprise a plurality of conductive sheets interconnected by at least one further conductive sheet, the plurality of conductive sheets of said first and second conductive elements being disposed alternately in an overlaying manner, separated by said dielectric material.

25. The antenna of claim 24 wherein said dielectric material comprises, in substantial portion, voids.

26. The antenna of claim 25 wherein said dielectric material comprises at least one non-conductive spacer separating said conductive elements, and a void.

27. The antenna of claim 24 wherein each said plurality of conductive sheets is disposed equidistant from the conductive sheets adjacent thereto.

28. The antenna of claim 24 wherein said plurality of conductive sheets are generally planar.

29. The antenna of claim 28 wherein said plurality of conductive sheets are relatively disposed in parallel.

30. The antenna of claim 28 wherein said further conductive sheets are perpendicular to said plurality of conductive sheets.

31. The antenna of claim 24 wherein said first conductive element further conductive sheet interconnects said first conductive element plurality of conductive sheets at interior points, such that each of said plurality of conductive sheets projects on both planar sides of said further conductive sheet, and said second conductive element includes at least two further conductive sheets disposed one on each planar side of said first element further conductive sheet, and respectively interconnects said second element plurality of conductive sheets such that said plurality of sheets project from the planar sides of said second element further conductive sheets facing said first element further conductive sheet.

32. The antenna of claim 1 wherein said predetermined multiple is one, whereby said resonant dimension is approximately equal to one-quarter wavelength at said predetermined frequency.

33. The antenna of claim 1 wherein said predetermined multiple is 2, whereby said resonant dimension is approximately equal to one-half wavelength at said predetermined frequency.

34. The antenna of claim 1 wherein said predetermined multiple is 4, whereby said resonant dimension is approximately equal to one full wavelength at said predetermined frequency.

35. The antenna of claim 17 wherein said predetermined multiple is one, whereby said resonant dimension is approximately equal to one-quarter wavelength at said predetermined frequency.

36. The antenna of claim 17 wherein said predetermined multiple is 2, whereby said resonant dimension is approximately equal to one-half wavelength at said predetermined frequency.

37. The antenna of claim 17 wherein said predetermined multiple is 4, whereby said resonant dimension is approximately equal to one full wavelength at said predetermined frequency.

* * * * *